United States Patent [19]

Saad

[11] Patent Number: 4,540,959

[45] Date of Patent: Sep. 10, 1985

[54] RECTANGULAR TO ELLIPTICAL WAVEGUIDE CONNECTION

[75] Inventor: Saad S. Saad, Willowbrook, Ill.

[73] Assignee: Andrew Corporation, Orland Park, Ill.

[21] Appl. No.: 554,178

[22] Filed: Nov. 22, 1983

[51] Int. Cl.[3] ..... H01P 1/16; H01P 5/08

[52] U.S. Cl. ..... 333/21 R; 333/35; 333/251

[58] Field of Search ..... 333/21 R, 34, 35, 251, 333/254

[56] References Cited

U.S. PATENT DOCUMENTS

| | | | |
|---|---|---|---|
| 2,432,093 | 12/1947 | Fox | 333/35 X |
| 2,767,380 | 10/1956 | Zobel | 333/35 |
| 3,019,399 | 1/1962 | Lanciani et al. | 333/35 X |
| 3,336,543 | 8/1967 | Johnson et al. | 333/21 R X |

FOREIGN PATENT DOCUMENTS

| | | | |
|---|---|---|---|
| 1261569 | 2/1968 | Fed. Rep. of Germany | 333/35 |

*Primary Examiner*—Paul Gensler

*Attorney, Agent, or Firm*—Leydig, Voit, Osann, Mayer & Holt, Ltd.

[57] ABSTRACT

A waveguide connection formed between a rectangular waveguide (11) and an elliptical waveguide (12) having a cutoff frequency and impedance different from those of the rectangular waveguide (11) comprises an inhomogeneous stepped transformer (10) having multiple sections (31,32,33) all having inside dimensions small enough to cutoff the first excitable higher order mode in a pre-selected frequency band, each section (31,32,33) of the transformer having an elongated transverse cross section which is symmetrical about mutually perpendicular transverse axes (X,Y) which are common to those of the waveguides (11,12), the dimensions of the said cross section increasing progressively from step to step in all four quadrants along the length of the transformer in the direction of both transverse axes (X,Y) so that both the cutoff frequency and the impedance of the transformer (10) vary monotonically along the length of the transformer (10).

5 Claims, 6 Drawing Figures

RECTANGULAR TO ELLIPTICAL WAVEGUIDE CONNECTION

TECHNICAL FIELD

The present invention relates to inhomogeneous waveguide connectors and transitions for joining rectangular waveguide to elliptical waveguide. An "inhomogeneous" waveguide connector in one for joining waveguides having different cutoff frequencies.

DESCRIPTION OF THE INVENTION

It is a primary object of the present invention to provide an improved inhomogeneous waveguide connector for joining rectangular waveguide to elliptical waveguide, and which provides a low return loss over a wide bandwidth.

A further object of this invention is to provide such an improved waveguide connector which is relatively easy to fabricate by machining so that it can be efficiently and economically manufactured with fine tolerances.

Yet another object of this invention is to provide an improved waveguide connector of the foregoing type which utilizes a stepped transformer, and characterized by a return loss which decreases as the number of steps is increased.

Other objects and advantages of the invention will be apparent from the following detailed description and the accompanying drawings.

In accordance with the present invention, the foregoing objectives are realized by an inhomogeneous waveguide connection comprising a rectangular waveguide; an elliptical waveguide having a cutoff frequency and impedance different from those of the rectangular waveguide; and a stepped transformer joining the rectangular waveguide to the elliptical waveguide, the transformer having multiple steps all of which have inside dimensions small enough to cut off the first excitable higher order mode in a preselected frequency band, each step of the transformer having an elongated transverse cross section which is symmetrical about mutually perpendicular transverse axes which are common to those of the rectangular and elliptical waveguides, the dimensions of the elongated transverse cross section increasing progressively from step to step in all four quadrants along the length of the transformer, in the direction of both of the transverse axes, so that both the cutoff frequency an the impedance of the transformer vary monotonically along the length of the transformer.

Figure 1:
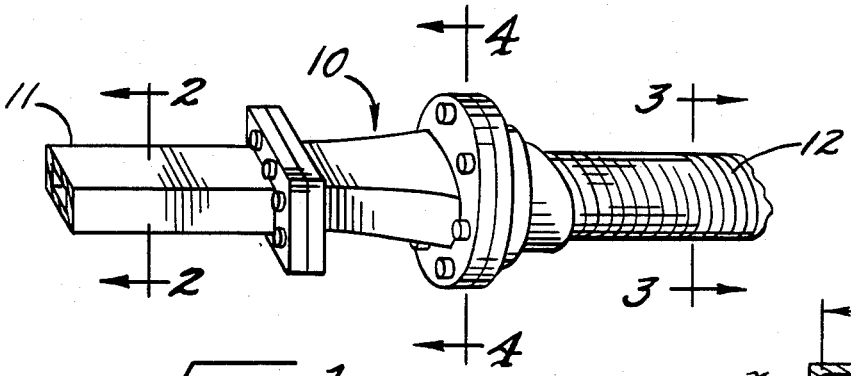
FIG. 1 is a partial perspective view of a waveguide connection embodying the present invention.

While the invention is susceptible to various modifications and alternative forms, specific embodiments thereof have been shown by way of example in the drawings and will be described herein. It should be understood, however, that it is not intended to limit the invention to the particular forms disclosed, but, on the contrary, the intention is to cover all modifications, equivalents, and alternatives falling within the spirit and scope of the invention as defined by the appended claims.

DESCRIPTION OF THE PREFERRED EMBODIMENTS

Figure 2:
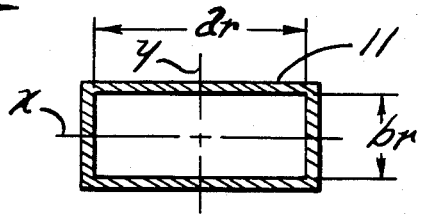
FIG. 2 is a section taken generally along line 2—2 in FIG. 1.
Figure 3:
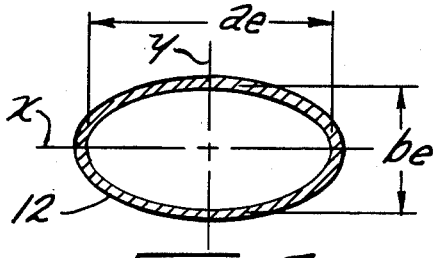
FIG. 3 is a section taken generally along line 3—3 in FIG. 1.
Figure 5:
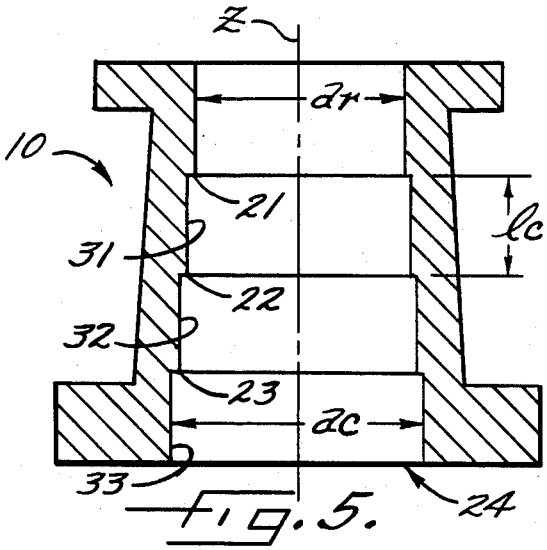
FIG. 5 is a section taken generally along line 5—5 in FIG. 4.
Figure 4:
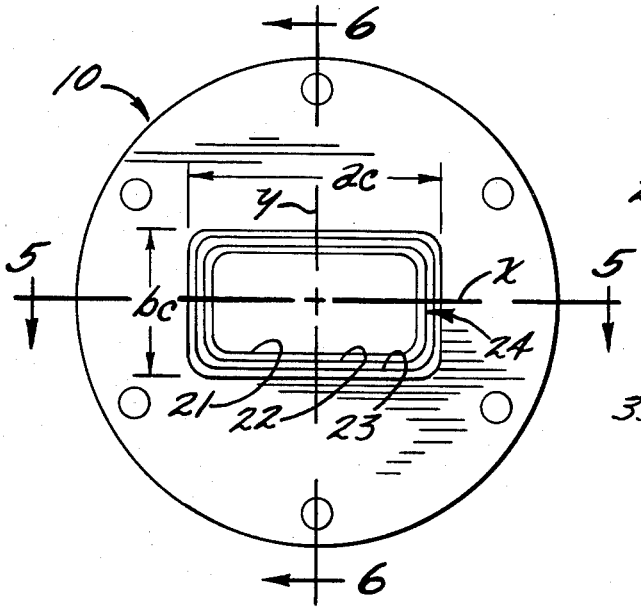
FIG. 4 is an enlarged view taken generally along line 4—4 in FIG. 1.
Figure 6:
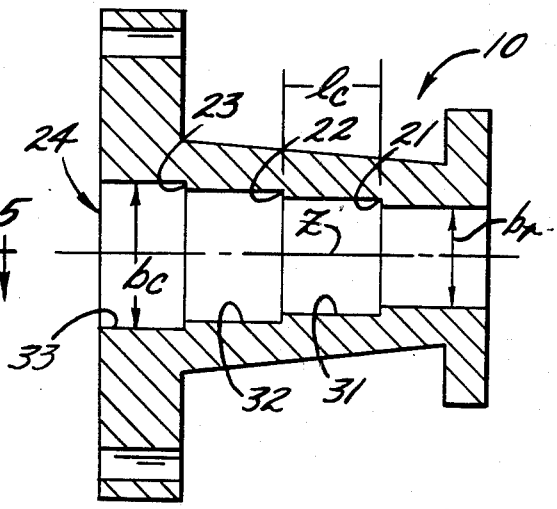
FIG. 6 is a section taken generally along line 6—6 in FIG. 4.

Turning now to the drawings and referring first to FIG. 1, there is shown a connector 10 for joining a rectangular waveguide 11 to an elliptical waveguide 12. The transverse cross sections of the rectangular waveguide 11 and the elliptical waveguide 12 are shown in FIGS. 2 and 3, respectively, and the transverse and longitudinal cross sections of the connector 10 are shown in FIGS. 4–6. The connector 10, the rectangular waveguide 11 and the elliptical waveguide 12 all have elongated transverse cross sections which are symmetrical about mutually perpendicular major and minor transverse axes x and y.

The rectangular waveguide 11 has a width $a_r$ along the x axis and a height $b_r$ along the y axis, while the elliptical waveguide 12 has a maximum width $a_e$ and a maximum height $b_e$ along the same axes. As is well known in the waveguide art, the values of $a_r$, $b_r$ and $a_e$, $b_e$ are chosen according to the particular frequency band in which the waveguide is to be used. These dimensions, in turn, determine the characteristic impedance $Z_c$ and cutoff frequency $f_c$ of the respective waveguides 11 and 12. For example, type-WR137, rectangular waveguide has a cutoff frequency $f_c$ of 4.30 GHz, and type-EW52 elliptical waveguide has a cutoff frequency $f_c$ of 3.57 GHz. Corresponding cutoff frequency values for other standard waveguide sizes, both rectangular and elliptical, are well known in the art.

As can be seen in FIGS. 4–6, the connector 10 includes a stepped transformer for effecting the transition between the two different cross sectional shapes of the waveguides 11 and 12. In the particular embodiment illustrated, the stepped transformer includes four steps 21, 22, 23 and 24, associated with three sections 31, 32 and 33, although it is to be understood that a greater or smaller number of steps may be utilized for different applications. Each of the three sections 31–33 has transverse dimensions which are large enough to propagate the desired mode therethough, but small enough to cut off the first excitable higher order mode. For any given cross sectional configuration, the upper limit on the transverse dimensions required to cut off higher order modes can be calculated using the numerical method described in R. M. Bulley, "Analysis of the Arbitrarily Shaped Waveguide by Polynomial Approximation", *IEEE Transactions on Microwave Theory and Techniques,* Vol. MTT-18, No. 12, December 1970, pp. 1022–1028.

The transverse dimensions $a_c$ and $b_c$ of the successive sections 31–33 of the transformer, as well as the longitudinal lengths $l_c$ of the respective sections, are also chosen to minimize the reflection at the input end of the connector 10 over a prescribed frequency band. The particular dimensions required to achieve this minimum reflection can be determined empirically or by computer optimization techniques, such as the razor search method (J. W. Bandler, "Computer Optimization of Inhomogeneous Waveguide Transformers," *IEEE Transactions on Microwave Theory and Techniques,* Vol.

MTT-17, No. 8, August 1969, pp. 563–571), solving for the known reflection equation:

$$\text{Reflection Coefficient} = (Y_{co} - Y_{in} - jB_1)/(Y_{co} + Y_{in} + jB_1)$$

If desired, the multiple sections 31–33 can all have the same longitudinal electrical length.

In accordance with one important aspect of the present invention, the inhomogeneous stepped transformer in the rectangular-to-elliptical connector has a generally rectangular transverse cross section which increases progressively from step to step along the length of the transformer, in the direction of both of the x and y axes, so that both the cutoff frequency and the impedance of the transformer vary monotonically along the length of the transformer. Thus, in the particular embodiment illustrated in FIGS. 4–6, the sections 31–33 have rectangular cross sections of width $a_c$ and height $b_c$, both of which are progressively increased from step 21 to step 22, from step 22 to step 23 and from step 23 to step 24. Step 24 is formed by the difference between the transverse dimensions of the elliptical waveguide 12 and the adjacent end of the connector 10, as can be seen in FIG. 5.

At the rectangular waveguide end of the connector, the width $a_r$ and height $b_r$ of the connector 10 are virtually the same as the width $a_4$ and height $b_r$ of the rectangular waveguide. At step 24, which is the elliptical waveguide end of the connector, the width $a_c$ and height $b_c$ of the connector 10 are smaller than the maximum width $a_e$ and maximum height $b_e$ of the elliptical waveguide by an increment comparable to the incremental increases in $a_c$ and $b_c$ at steps 21, 22 and 23.

As can be seen in FIG. 4, the rectangular cross-sections of the stepped transformer have arcuate corners. Although this corner radius is relatively small, it can be increased up to about one half of the height $b_c$ of the rectangular section, if desired.

In order to expand and/or shift the frequency band over which the connector of this invention provides an improved return loss, a capacitive or inductive iris may be provided at the elliptical waveguide end of the connector.

By increasing the internal transverse dimensions of the successive sections of the inhomogeneous transformer along both the major and minor transverse axes x and y, both the cutoff frequency $f_c$ and the impedance $Z_c$ are varied monotonically along the length of the transformer. This provides a good impedance match between the transformer and the different waveguides connected thereby, resulting in a desirably low return loss (VSWR) across a relatively wide frequency band. For example, a return loss of −36 dB has been obtained across a frequency band of 5.6 to 7.4 GHz in a WR137-EW52 connector having three quarter-wave sections along a transformer two inches in length and a capacitive iris with a height of 0.8" at the elliptical waveguide end. Even lower return losses can be achieved with longer connectors having more steps.

This invention is in contrast to prior art rectangular-to-elliptical waveguide connectors using inhomogeneous stepped transformers in which the transverse dimension was varied only along the minor transverse axis. In such a transformer the variation in cutoff frequency along the length of the transformer is not monotonic, increasing at one or more steps of the transformer and decreasing at one or more other steps, and leading to relatively high return losses. Stepped transformers with rectangular cross sections that varied along both transverse axes have also been used in the prior art, but not for joining elliptical waveguide to rectangular waveguide. It is surprising that a connector with a rectangular cross section would provide such excellent performance when joined to waveguide having an elliptical cross section and a cutoff frequency different from that of the rectangular waveguide to which it is being connected.

In one working example of the embodiment of FIGS. 4–6, using a three-section transformer designed for joining type-WR137 rectangular waveguide to type-EW52 corrugated elliptical waveguide, the connector had a constant corner radius of 0.125 inch and the following dimensions (in inches):

| | $a_c$ | $b_c$ | $l_c$ |
|---|---|---|---|
| section 31 | 1.442 | 0.675 | 0.679 |
| section 32 | 1.512 | 0.778 | 0.655 |
| section 33 | 1.582 | 0.902 | 0.635 |

Type-WR137 rectangular waveguide is designed for an operating frequency band of 5.85 to 8.20 GHz and has a width $a_r$ of 1.372 inches and a height $b_r$ of 0.622 inches. Type-EW52 corrugated elliptical waveguide is designed to operate in a frequency band of 4.6 to 6.425 GHz and has a major dimension $a_e$ of 1.971 inches and a minor dimension $b_e$ of 1.025 inches ($a_e$ and $b_e$ are measured by averaging the corrugation depth). In an actual test this particular connector produced a return loss that was better than −28 dB in the 5.6 to 7.6 GHz frequency band (30% bandwidth) and better than −34 dB in the 6.15 to 7.25 GHz band (16% bandwidth). Although this connector provides low return losses over a wide frequency band, as a practical matter this connector would be used only in the frequency band from about 5.6 to 6.4 GHz because higher order modes are generated above 6.48 GHz.

In another example of the embodiment shown in FIGS. 4–6, the stepped transformer was designed with four sections, again for use in connecting a type-WR137 rectangular waveguide to a type-EW52 elliptical waveguide. This four-step connector had a constant corner radius of 0.125 inch and the following dimensions (in inches):

| | $a_c$ | $b_c$ | $l_c$ |
|---|---|---|---|
| section 31 | 1.428 | 0.645 | 0.701 |
| section 32 | 1.484 | 0.705 | 0.674 |
| section 33 | 1.540 | 0.805 | 0.652 |
| section 34 | 1.596 | 0.915 | 0.635 |

In an actual test of the latter transformer, a return loss of better than −40 dB was obtained over a frequency band of 6.05–6.55 GHz which was expanded to 5.9–6.65 GHz with a 0.86-inch capacitive iris.

As can be seen from the foregoing detailed description, this invention provides an improved waveguide connector for joining rectangular waveguide to elliptical waveguide, while providing a low return loss over a wide bandwidth. This connector is relatively easy to fabricate by machining so that it can be efficiently and economically manufactured with fine tolerances without costly fabricating techniques such as electroforming and the like. Since the connector utilizes a stepped transformer, the return loss decreases as the number of steps is increased so that the connector can be optimized for minimum length or minimum return loss, or any desired combination of the two, depending upon the requirements of any given practical application.

I claim as my invention:

1. A waveguide connection comprising the combination of a rectangular waveguide, an elliptical waveguide having a cutoff frequency and impedance different from those of said rectangular waveguide, an inhomogeneous stepped transformer joining said rectangular waveguide to said elliptical waveguide, said transformer having multiple sections all of which have inside dimensions small enough to cut off the first excitable higher order mode in a preselected frequency band, each section of said transformer having an elongated transverse cross section which is symmetrical about mutually perpendicular transverse axes which are common to those of said rectangular and elliptical waveguides, and the inside dimensions of said elongated transverse cross section increasing progressively from step to step in all four quadrants along the length of the transformer and at each step in the transformer, in the direction of both of said transverse axes, so that both the cutoff frequency and the impedance of said transformer vary monotonically along the length of said transformer.

2. A waveguide connection as set forth in claim 1 wherein said transverse cross section of said transformer has a generally rectangular shape, the width and height of said rectangular shape increasing progressively from step to step along the length of said transformer.

3. A waveguide connection as set forth in claim 2 wherein said generally rectangular shape of said transverse cross section has arcuate corners.

4. A waveguide connection as set forth in claim 1 wherein said cutoff frequency of said transformer progressively increases, at each step, from the waveguide with the lower cutoff frequency toward the waveguide with the higher cutoff frequency.

5. A waveguide connection as set forth in claim 1 wherein said impedance of said transformer progressively increases from the waveguide with the lower impedance toward the waveguide with the higher impedance.

* * * * *